US007535432B1

(12) United States Patent
Dean et al.

(10) Patent No.: US 7,535,432 B1
(45) Date of Patent: May 19, 2009

(54) UNIVERSAL ANTENNA POLARIZATION SELECTIVITY VIA VARIABLE DIELECTRIC CONTROL

(75) Inventors: Jeffery A. Dean, Clermont, FL (US); William S. McKinley, Clermont, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 219 days.

(21) Appl. No.: 11/472,151

(22) Filed: Jun. 20, 2006

Related U.S. Application Data

(60) Provisional application No. 60/782,363, filed on Mar. 14, 2006.

(51) Int. Cl.
*H01Q 1/50* (2006.01)

(52) U.S. Cl. ..... 343/850

(58) Field of Classification Search ..... 343/850, 343/853, 767, 700 MS, 881, 915
See application file for complete search history.

(56) References Cited

U.S. PATENT DOCUMENTS 4,359,741 A * 11/1982 Cassel ..... 343/754
7,126,553 B1 * 10/2006 Fink et al. ..... 343/767
7,202,734 B1 * 4/2007 Raab ..... 330/126
7,205,955 B2 * 4/2007 Shirosaka et al. ..... 343/850
7,215,284 B2 * 5/2007 Collinson ..... 343/700 MS
7,298,332 B2 * 11/2007 Ryken et al. ..... 343/700 MS
2004/0017326 A1 * 1/2004 Merrill ..... 343/853

OTHER PUBLICATIONS

Varadan, V. K., et al., "Design and development of electronically tunable microstrip antennas", *Smart Mater. Struct.8*, 1999 IOP Publishing Ltd.,(Feb. 10, 1999),238-242.

* cited by examiner

*Primary Examiner*—Huedung Mancuso
(74) *Attorney, Agent, or Firm*—Jeffrey D. Myers; Peacock Myers, P.C.; Timothy D. Stanley

(57) ABSTRACT

An antenna and a corresponding method of creating any polarization state in an antenna comprising providing to the antenna a single power input, dividing the power received from the single power input, transmitting the divided power to a combiner network via a first plurality of transmission lines, and transmitting power from the combiner network to a radiating element via a second plurality of transmission lines.

18 Claims, 2 Drawing Sheets

UNIVERSAL ANTENNA POLARIZATION SELECTIVITY VIA VARIABLE DIELECTRIC CONTROL

CROSS-REFERENCE TO RELATED APPLICATIONS

A related application entitled "Dynamic, Non Frequency Dispersive, RF Power Division by Means of Variable Dielectric Material Properties" is being filed concurrently herewith, to Jeffery A. Dean and William S. McKinley, Ser. No. 11/455,731, and the specification and claims thereof are incorporated herein by reference.

This application claims priority to and the benefit of the filing of U.S. Provisional Patent Application Ser. No. 60/782,363, entitled "Single Input Circular and Slant Polarization Selectivity by Means of Dielectric Control", filed on Mar. 14, 2006, and the specification and claims thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The present invention relates to methods and apparatuses to control antenna polarization states.

2. Description of Related Art

Multiple polarization antennas are typically implemented through a conjunction of either electrical or mechanical switching, electrical or mechanical attenuation, electrical or mechanical phase shifting, and dedicated transmission line routing definitions. Digital post-processing software may also be employed to provide a virtual sense of polarization diversity. Mechanical switches degrade over time and have limited high frequency application while high frequency electrical switches are relatively expensive. Digital electronic phase shifters are able only to adjust the phase in discrete increments, resulting in polarization degradation, while predictable electronic control of analog phase shifters is difficult to implement while remaining relatively expensive. Attenuators reduce the RF efficiency of the entire concept by "throwing away" RF power to achieve the desired power balance between the orthogonal ports. The drawback of using software is that the answer is not "real time" and requires significant effort to design a flexible software/hardware interface. The present invention eliminates the discrete switch and phase shifter requirements by means of a low cost, monolithic, integrated collection of simple transmission lines controlled by means of variable dielectric.

BRIEF SUMMARY OF THE INVENTION

The present invention is of an antenna and a corresponding method of creating any polarization state in an antenna, comprising: providing to the antenna a single power input; dividing the power received from the single power input; transmitting the divided power to a combiner network via a first plurality of transmission lines; and transmitting power from the combiner network to a radiating element via a second plurality of transmission lines. In the preferred embodiment, either or both of the first and second plurality of transmission lines comprises a variable dielectric material, most preferably wherein either or both of the first and second plurality of transmission lines comprises barium-strontium-titanate. A voltage is applied to at least one of the transmission lines via a control line, preferably a separate voltage to each of the transmission lines. The first plurality of transmission lines provides any desired power division to the combiner network, preferably wherein the power division is controlled by relative phases between each of the first plurality of transmission lines. Relative phases are controlled between each of the second plurality of transmission lines. The antenna can provide any desired polarization of output. The radiating element is a preferably a microstrip patch antenna.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

For applications such as RADAR and passive imaging, it is often desirable to realize multiple antenna polarizations in order to improve system performance. The present invention describes an apparatus and method for obtaining any antenna polarization state (e.g., right hand circular, left hand circular, slant-linear, and elliptical) from a single RF (radio frequency) source. The invention employs variable dielectric materials to control the amplitude and phase of the single input signal to properly supply two nominally orthogonally polarized antenna inputs. This is accomplished by cascading two independently controlled paraelectric material (such as Barium-Strontium-Titanate (BST)) based transmission line stages. The first stage controls the power distribution between the orthogonal antenna ports. The second stage controls the relative phasing between antenna ports. This invention combines the techniques detailed in U.S. patent application Ser. Nos. 11/455,731 and 60/782,363 and consists of a single-input device that is capable of generating multiple polarizations without loss of overall RF power efficiency.

Figure 1A:
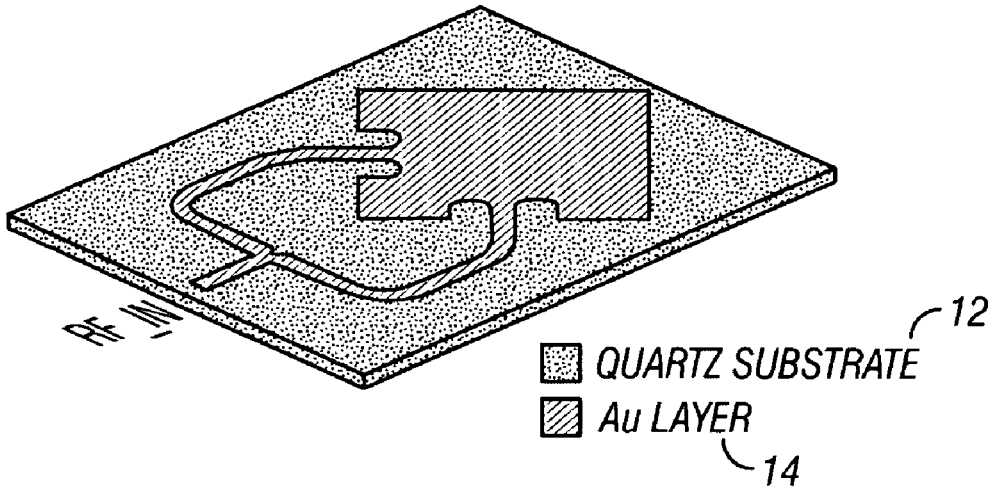
FIG. 1A (Prior Art)
FIGS. 1(*a*) and 1(*b*) are schematic diagrams of prior apparatuses generating one or two polarizations, respectively.
Figure 1B:
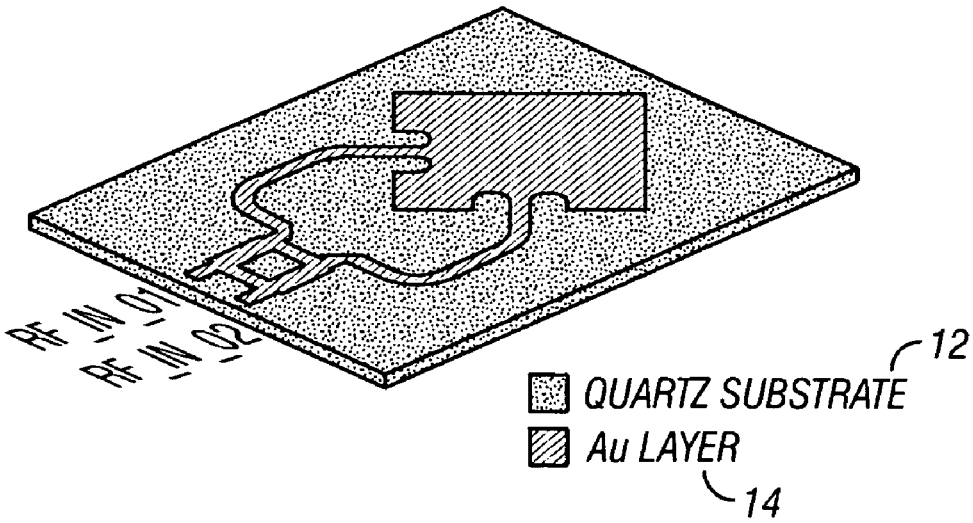
FIG. 1B (Prior Art)

As shown in FIG. 1(*a*), a typical single-input antenna will have only a single polarization (such as linear or circular) associated with it. Two achieve additional polarizations, as shown in FIG. 1(*b*), two RF antenna inputs are required. U.S. Patent Application Ser. No. 60/782,363 partially solved the problem by offering a solution that controlled the relative phasing between the antenna input ports. That approach results in the generation of several unique polarization states. However, many useful polarization states cannot be produced by controlling the relative phasing between antenna ports alone. In order to generate any arbitrary linear, elliptical, or circular polarization, both phase and amplitude control is required. The present invention accomplishes that goal.

The invention is comprised of three primary components that are cascaded together to form the overall system. The first component is the power division device disclosed in U.S. patent application Ser. No. 11/455,731. The next component is similar to the phase control device disclosed in U.S. Patent Application Ser. No. 60/782,363. The final component is an antenna, such as a microstrip patch antenna, that has two nominally orthogonally polarized input ports. The integrated combination can consist of a single piece monolithic substrate well suited for economical manufacture.

Figure 2:
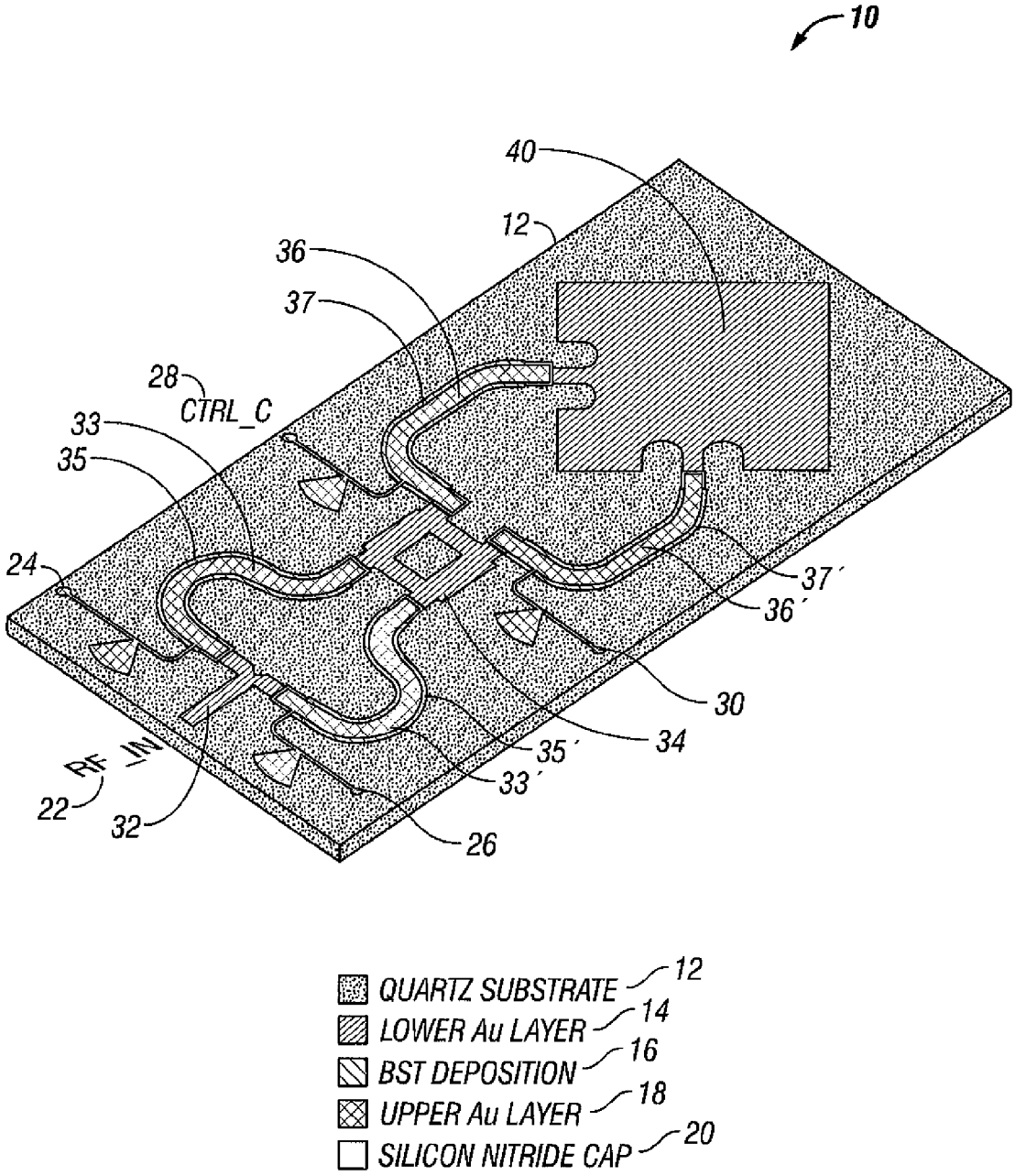
FIG. 2 is a schematic diagram of the present invention for obtaining any desired antenna polarization state.

As shown in FIG. 2, the preferred apparatus 10 of the invention consists of an initial stage comprising a center-fed RF power splitter 32 receiving input from a single RF input 22, two independent transmission lines 33,33' on a variable dielectric (paraelectric) material 35,35' (such as BST), and a hybrid combiner network 34. The RF power splitter preferably yields equal signal power levels on the two transmission lines. By properly altering the dielectric properties of each paraelectric BST deposition, by means of applied DC voltage via control lines 24,26, the relative phases between the two transmission lines are changed. These two transmission lines are then fed into the hybrid combiner network, preferably comprising two inputs and two outputs. Any desired power division between the two outputs is thus achievable by changing the relative phases between the input lines.

The second stage preferably comprises two separate transmission lines 36,36', each residing on independent variable dielectric BST depositions 37,37'. The dielectric properties of each material are controllable via DC voltages via control lines 28,30. By properly altering the DC voltages, the relative phases between these two transmission lines are altered.

The final stage is a dual-input antenna 40. Each input to the antenna excites a polarization that is nominally orthogonal to the polarization excited by the other input, and is fed by the respective transmission line from the previous stage. One example of an antenna that meets this specification is a dual fed microstrip patch antenna, as shown in FIG. 2. Other antenna concepts would employ some form of ortho-mode transducer to achieve the requisite orthogonal RF relationship.

FIG. 2 also shows preferred construction materials and layers, including a base substrate 12 (e.g., quartz, alumina, sapphire), lower conductive layer 14 (e.g., gold, silver, copper), variable dielectric (paraelectric) material 16 (e.g., BST), upper conductive layer 18 (e.g., gold), and capping layer 20 (e.g., silicon nitride).

In summary, the first stage controls the amplitude division between the antenna ports. The second stage controls the relative phase offset between the antenna ports. The final stage consists of the antenna itself. By controlling both the amplitude and phase between two orthogonally polarized antenna inputs, any arbitrary polarization is achievable.

In the representation shown in FIG. 2, vertical polarization is achieved by simply diverting all applied RF power into only one antenna port. Horizontal polarization is achieved by directing all applied RF power into the other antenna port. Slant linear polarization is created by dividing the RF power equally between the ports while maintaining an equal phase relationship between the input ports. Right hand circular polarization is achieved by dividing the power equally between the ports, and introducing a +90° phase differential between ports. Left hand circular polarization is accomplished by dividing the power equally between the ports, and introducing a −90° phase differential between ports.

The present invention exhibits reciprocal functionality and thus may be employed for both transmit and receive configurations. Additionally, all of these components can exist on a common monolithic substrate, such as quartz, thus making manufacturing easier and less costly.

The present invention is particularly useful for advanced sensors and radar and active phased arrays, or any other application where multiple antenna polarizations are desirable.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An antenna and feed network therefor configured to achieve any possible polarization state, said antenna and feed network comprising:

a single power input;

a radiating element;

a power divider receiving power from said single power input;

a first plurality of transmission lines extending from said power divider to a combiner network; and a second plurality of transmission lines extending from said combiner network to said radiating element; and wherein said antenna while in operation switches between any possible polarizations of output without electrical or mechanical switching, attenuation, or dedicated transmission line routing definitions.

2. The antenna of claim 1 wherein either or both of said first and second plurality of transmission lines comprises a variable dielectric material.

3. The antenna of claim 2 wherein either or both of said first and second plurality of transmission lines comprises barium-strontium-titanate.

4. The antenna of claim 1 additionally comprising voltage control lines to at least one of said transmission lines.

5. The antenna of claim 4 additionally comprising voltage control lines to each of said transmission lines.

6. The antenna of claim 1 wherein said first plurality of transmission lines provides any desired power division to said combiner network.

7. The antenna of claim 6 wherein the power division is controlled by relative phases between each of said first plurality of transmission lines.

8. The antenna of claim 1 wherein relative phases between each of said second plurality of transmission lines are controllable.

9. The antenna of claim 1 wherein said radiating element is a microstrip patch antenna.

10. A method of creating any possible polarization state in an antenna, the method comprising the steps of:

providing to the antenna a single power input;

dividing the power received from the single power input;

transmitting the divided power to a combiner network via a first plurality of transmission lines; and transmitting power from the combiner network to a radiating element via a second plurality of transmission lines; and wherein the antenna while in operation switches between any possible polarizations of output without electrical or mechanical switching, attenuation, or dedicated transmission line routing definitions.

11. The method of claim 10 wherein either or both of the first and second plurality of transmission lines comprises a variable dielectric material.

12. The method of claim 11 wherein either or both of the first and second plurality of transmission lines comprises barium-strontium-titanate.

13. The method of claim 10 additionally comprising the step of applying a voltage to at least one of the transmission lines via a control line.

14. The method of claim 13 wherein the applying step comprises applying a separate voltage to each of the transmission lines.

15. The method of claim 10 wherein the first plurality of transmission lines provides any desired power division to the combiner network.

16. The method of claim 15 wherein the power division is controlled by relative phases between each of the first plurality of transmission lines.

17. The method of claim 10 additionally comprising the step of controlling relative phases between each of the second plurality of transmission lines.

18. The method of claim 10 wherein the radiating element is a microstrip patch antenna.

* * * * *